US005219302A

United States Patent [19]

Robertson et al.

[11] Patent Number: 5,219,302

[45] Date of Patent: Jun. 15, 1993

[54] CROSSCONNECT TERMINAL BLOCK

[75] Inventors: James W. Robertson, Oberlin; Francis J. Shay, Palmyra, both of Pa.

[73] Assignee: AMP Incorporated, Harrisburg, Pa.

[21] Appl. No.: 708,405

[22] Filed: May 31, 1991

[51] Int. Cl.[5] ..... H01R 4/24

[52] U.S. Cl. ..... 439/404; 439/403; 439/713; 439/410

[58] Field of Search ..... 439/409–413, 439/417, 418, 709, 711, 712, 713, 716, 717, 718, 540, 402–404

[56] References Cited

U.S. PATENT DOCUMENTS

| | | | |
|---|---|---|---|
| 3,777,223 | 12/1973 | Chandler et al. | 439/719 |
| 4,175,820 | 11/1979 | Wilmes et al. | 439/712 |
| 4,508,411 | 4/1985 | Hughes et al. | 439/711 |
| 4,861,283 | 8/1989 | Beaulieu et al. | 439/540 |
| 4,875,881 | 10/1989 | Caveny et al. | 439/540 |
| 4,929,190 | 5/1990 | Gonon et al. | 439/409 |
| 4,993,970 | 2/1991 | Littrell | 439/540 |
| 5,006,077 | 4/1991 | Loose et al. | 439/409 |

*Primary Examiner*—David L. Pirlot
*Attorney, Agent, or Firm*—Anton P. Ness

[57] ABSTRACT

An enclosure for terminal blocks for interconnecting conductors of multiconductor cables includes provision for two or more terminal block modules. Each terminal block module includes two terminal blocks defined by a tubular housing section extending from a common base section of a dielectric housing and has an annular cavity extending to an open end, and a tubular one-piece terminal is secured therewithin around a center post of the housing section and is rotatable therewithin by a generally tubular actuator also within said annular cavity and adapted to be rotated during splicing of wires. Each terminal block includes a pair of wire-receiving apertures into which wire ends are inserted to extend through insulation piercing slots of said terminal, and upon actuating rotation said slots pierce the insulation and engage the conductor of each wire thus interconnecting them.

11 Claims, 6 Drawing Sheets

CROSSCONNECT TERMINAL BLOCK

FIELD OF THE INVENTION

The present invention relates to the field of electrical connectors and more particularly to connectors for connecting pairs of signal wires together.

BACKGROUND OF THE INVENTION

In the telecommunications industry telephone cable is introduced to individual telephone sites such as residences, mainly through use of a splice of the signal wires of the cable to respective house wires at a junction located outside or inside the house. The junction is housed within a protective enclosure which is mounted usually to an outside wall of the house. One example of an assembly of a splice terminal block and enclosure therefor is sold by Raychem Corporation under the product identification D'TERMINATOR XB2 (trademark of Raychem Corporation), and the product has the capacity to crossconnect one or two separate telephone lines within the enclosure. Ends of the house cable and the drop cable from the transmission line enter the enclosure; each of the pair of signal wires of each cable is prepared to be spliced to its respective counterpart in the other cable; and the prepared wire ends are then placed within a terminal which is manipulated to penetrate the insulation of both wires to engage the conductors and thus interconnect them. Terminal blocks also provide dielectric protective structure around the splice, and together with the enclosure provide protection from the environment, especially from water, dust, and other contaminants and also from insects and animals. Such enclosures must be capable of being reopened to expose the terminal blocks for service and repair as needed.

One type of terminal block for interconnecting a pair of wires is disclosed in U.S. Pat. No. 5,006,077. A tubular dielectric housing has a center post therein defining an annular cavity. A stationary tubular terminal is affixed within the cavity adjacent the center post; a rotatable tubular terminal is disposed within the cavity concentrically around the stationary terminal and in electrical engagement therewith at all times; and a tubular actuator is also mounted to the housing and is adapted to be rotated between actuated and unactuated positions to rotate the rotatable terminal. A pair of wire-receiving apertures extend through apertures through the housing wall, through apertures of both terminals and the actuator, and at least into a center post aperture, all aligned in an unactuated state for a wire end to be inserted thereinto. Upon rotation of the rotatable terminal by the actuator, slot walls of the terminal pierce the wire insulation and engage the wire's conductor. The stationary terminal includes a contact section extending outwardly from the housing including insulation displacement slots for a wire to be inserted thereinto and terminated, for a multiconductor stub cable length to be secured to the enclosure containing a plurality of the terminal blocks, thus defining a cable harness. The two terminal members thus interconnect an appropriate conductor of the stub cable to a wire inserted into the terminal block. A second set of wire-receiving apertures can be utilized to receive a second inserted wire end to be interconnected with the first and with the stub cable conductor.

It would be desired to provide a terminal block which has few components, is easy to assemble, is inexpensive to manufacture, and provides an assured electrical connection between the spliced wires. It would also be desirable to provide such a terminal block which can splice two different wire sizes, such as 18 AWG and also 24 AWG, whichever may be encountered by the service personnel at the site of the junction.

SUMMARY OF THE INVENTION

The present invention is a terminal block having a single-piece terminal with connecting sections for both wires to be spliced, which are of the insulation piercing or displacement type which eliminates the need for stripping the insulation from the signal wire conductors. A dielectric housing includes an integrally molded center post within a tubular terminal-receiving housing section, both coextending from a common base section and defining an annular cavity, the housing section providing wire-receiving openings through side walls and into the cavity aligned with an aperture through the center post, enabling insertion of wire ends during splicing.

A barrel terminal and an associated lug-capped tubular actuator is then assembled to the housing, with the barrel terminal surrounding the center post within the cavity and having apertured insulation displacement contact sections which are initially aligned with the wire-receiving openings of the housing and center post, and the actuator also having profiled apertures therethrough extending partially around the circumference and also aligned with the wire-receiving openings of the housing, center post and terminal. The lug extends above the housing upon assembly to be accessible to tooling for rotation thereof to rotate the actuator and the terminal, and may be adapted for rotation such as being hexagonally shaped corresponding to a wrench having a hexagonal work end recess of appropriate size.

During splicing the wire ends of both wires are inserted into respective openings and through the apertured contact sections until stopped by abutment with corresponding stop surfaces of the housing which then holds the wire ends at two spaced locations, both outside and within the terminal wall; the actuator is then rotated through an angular distance of about a quarter turn in turn rotating the terminal, and the constricted edges of a precisely profiled slot extending from each of the terminal's apertures penetrate the wire insulation of both wires simultaneously and engage the conductors therewithin, completing the splice. A narrow end of the profiled actuator apertures, upon actuator rotation, engages and impinges the insulation of the wires between the terminal and the cavity side wall to provide strain relief.

Another aspect of the present invention is the modular nature of the pair of terminal blocks defined in the same housing member. Such a housing member of two terminal blocks can be selectively mounted in an enclosure adapted for a plurality of such modules, in a selected orientation such that the wire-receiving openings of each of the terminal blocks are oriented facing a cable exit of the enclosure or other common point from where the pairs of conductors originate as discrete wires from two cables. An enclosure for such modules can have a pair of locating bosses and mounting means and a visual display or "footprint" to identify the position for each such module, and when the modules have an asymmetrical shape the correspondingly shaped footprint can identify the appropriate, polarized orientation of such a module.

It is an objective of the present invention to provide a crossconnect terminal block mounted within a protective enclosure and which effectively and easily splices insulated ends of a pair of wires.

It is also an objective to provide such a terminal block having a minimal number of separate parts and is economical to produce and assemble.

It is additionally an objective to provide a terminal block which is modular and easily mountable within an enclosure, enabling simplification of the enclosure and permitting the same enclosure design to be adapted for mounting a selected plurality of such terminal blocks as desired.

An embodiment of the present invention will now be described by way of example with reference to the accompanying drawings.

DETAILED DESCRIPTION OF THE PREFERRED EMBODIMENT

Figure 1:
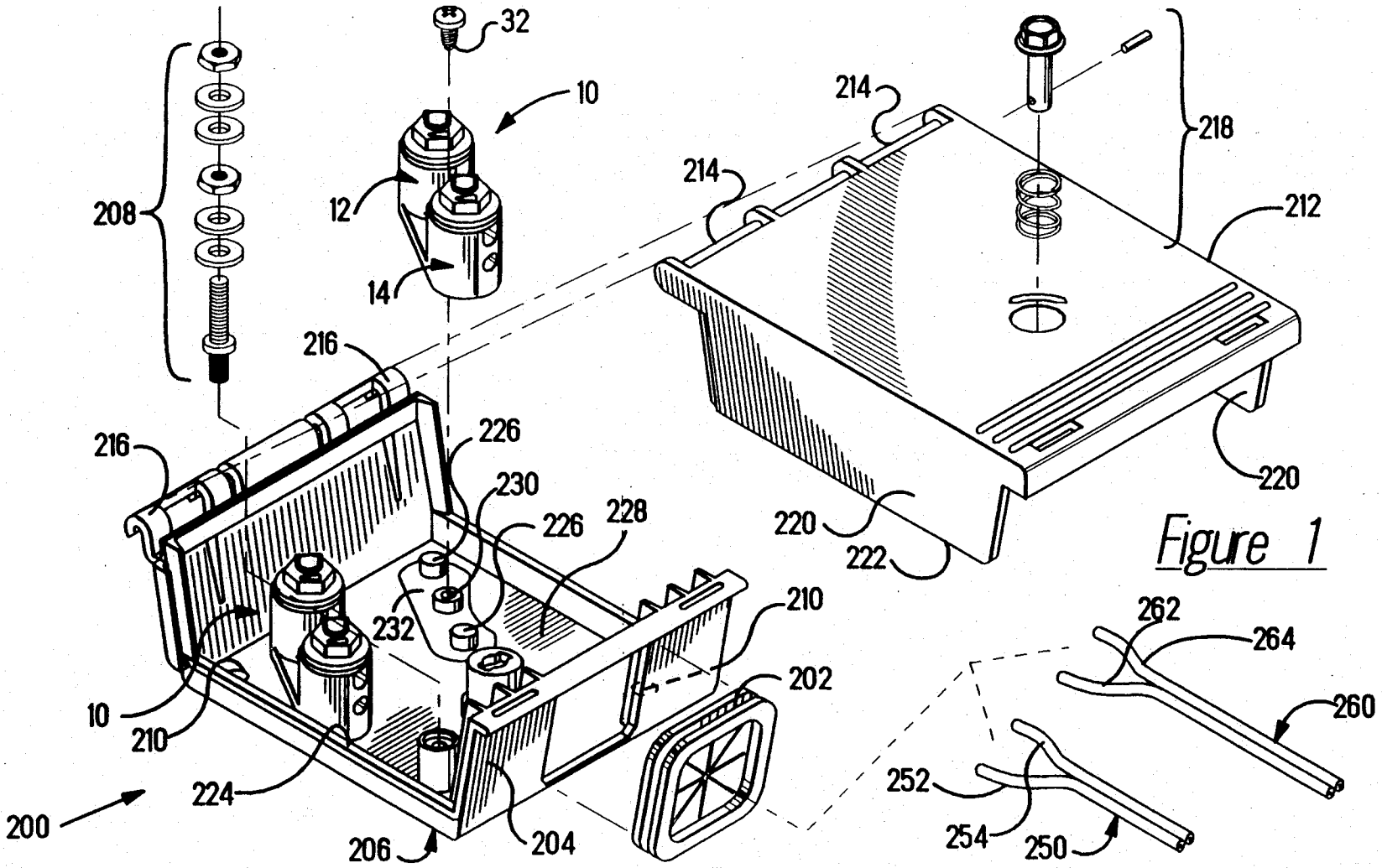
FIG. 1 is an isometric view partially exploded of an enclosure containing a pair of the terminal blocks of the invention having wires to be spliced therewithin.

Enclosure 200 in FIG. 1 is shown to contain two modules 10 each containing a pair of terminal blocks 12,14 of the present invention, and is of the type disclosed in greater detail in U.S. patent application Ser. No. 07/708,407 filed May 31, 1991, U.S. Pat. No. 5,145,388 and assigned to the assignee hereof. Drop cable 250 exits enclosure 200 at grommeted exit 202 through front wall 204 of enclosure body 206 and includes first and second insulated conductor wires 252,254; similarly house cable 260 exits at grommeted exit 202 and includes third and fourth conductor wires 262,264 which are spliced with first and second wires 252,254 respectively in terminal blocks 12,14 of one of modules 10. Enclosure 200 has a ground contact 208 for connection of shielding of certain cables 252,254 to ground wires (not shown) leading to outside ground for lightning protection. Enclosure body 206 has mounting holes 210 enabling mounting by conventional screw fasteners to a wall or post for example.

Enclosure lid 212 secured to, and is pivotable with respect to body 206 by means of dowels 214 received into and held within arcuate slots of hooks 216, and locked into a closed position by spring-loaded lock 218. Such pivot mechanism is disclosed in U.S. patent application Ser. No. 07/708,401 filed May 31, 1991, U.S. Pat. No. 5,146,650 and assigned to the assignee hereof. Lid 212 is shown to include side walls 220 for enclosure 200, permitting enclosure body 206 to be open along sides thereof allowing unimpeded access to terminal blocks 12,14 to facilitate splicing of the wire ends when enclosure 200 is opened. Side walls 220 have lower edges 222 receivable alongside and against upper edges of wall sections 224 of enclosure body 206 and are especially adapted to establish sealing when enclosure 200 is closed.

Figure 2:
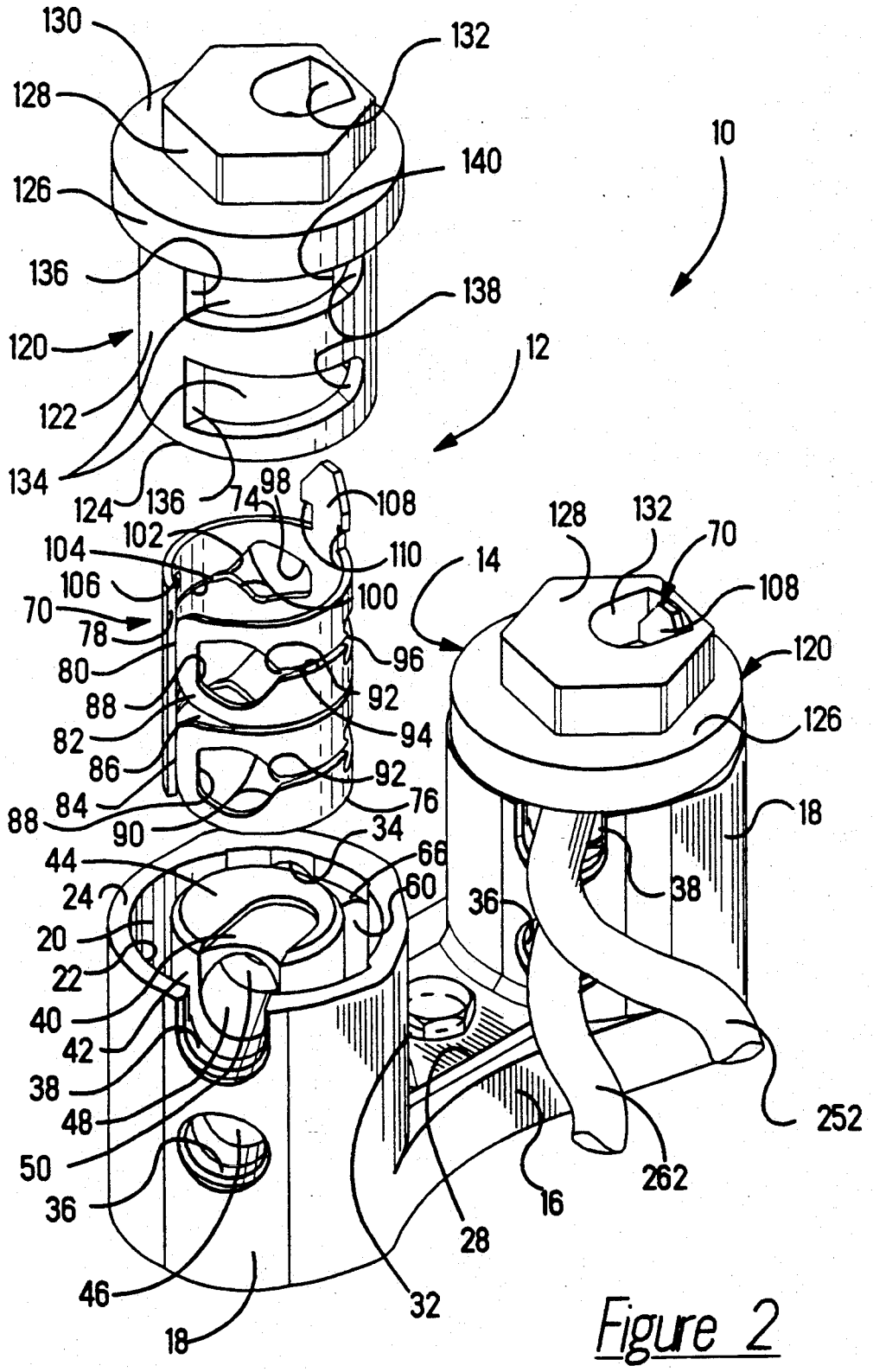
FIG. 2 is an isometric view of a terminal block pair, with the terminal and actuator of one of the terminal blocks exploded from its housing.

In FIGS. 1 and 2 representative module 10 includes an integral housing member 16 molded of plastic such as a blend of polyvinyl chloride and acrylonitrile-butadienestyrene copolymer resins. Module 10 includes a pair of terminal blocks 12,14 each of which is a generally cylindrical housing section 18 of housing member 16 which includes a large cavity 20 defined by cylindrical sidewall 22 (shown oriented vertically) and extending to annular edge 24. Recess 26 below each housing 18 receives a respective one of positioning embossments 226 rising from floor 228 of enclosure 200. Between housing sections 18 is an intermediate base portion defining a mounting flange 28 including a profiled mounting aperture 30 accessible between the housing sections 18 and therefor adapted to enable a fastener 32 to be threaded into apertured embossment 230 rising from enclosure floor 228. The shape of mounting flange 28 can be asymmetrical, and a footprint 232 defined on floor 228 can be correspondingly shaped to provide a visual identification of both the location and appropriately polarized orientation of housing module 16 with respect to cable exit 202. Wire entrance apertures 36,38 extend through sidewall 22 of housing section 18 and are both aligned generally with grommeted cable exit 202 to facilitate insertion of ends of wires 252,262 or 254,264 thereinto for being spliced together, and the wire entrance apertures can be aligned at an angular offset with respect to the plane containing the centerlines of terminal blocks 12,14 with the angle (such as 31°) selected to minimize the amount of floor space of the enclosure for the modules.

Center post 40 is molded integrally to the housing within cavity 20 and having an outer, generally cylindrical surface 42 radially spaced from sidewall 22 thereof, with a leading end 44 extending slightly beyond annular edge 24. Wire-receiving passageways 46,48 of center post 40 are aligned with associated ones of wire entrance apertures 36,38 of sidewall 22 for eventual receipt of wire ends 256,266 or 258,268 therethrough for splicing or interconnection. While wire entrance apertures 36,38 of sidewall 22 are wide enough to receive the larger 18 AWG size wire therethrough, wire-receiving passageways 46,48 are profiled as disclosed in U.S. Pat. No. 5,006,077 to receive and stop the end of a larger 18 AWG wire at tapered transition section 50 located between larger diameter passageway portion 52 and smaller diameter passageway portion 54. Passageways 46,48 are adapted, with tapered transition portion 50 acting as a lead-in to prevent stubbing, to permit the end of a smaller 24 AWG size wire to pass completely therethrough and exit the center post 40 and continue until stopped by stop recess 34 in sidewall 22 opposed from wire entrance apertures 36,38.

Figure 3:
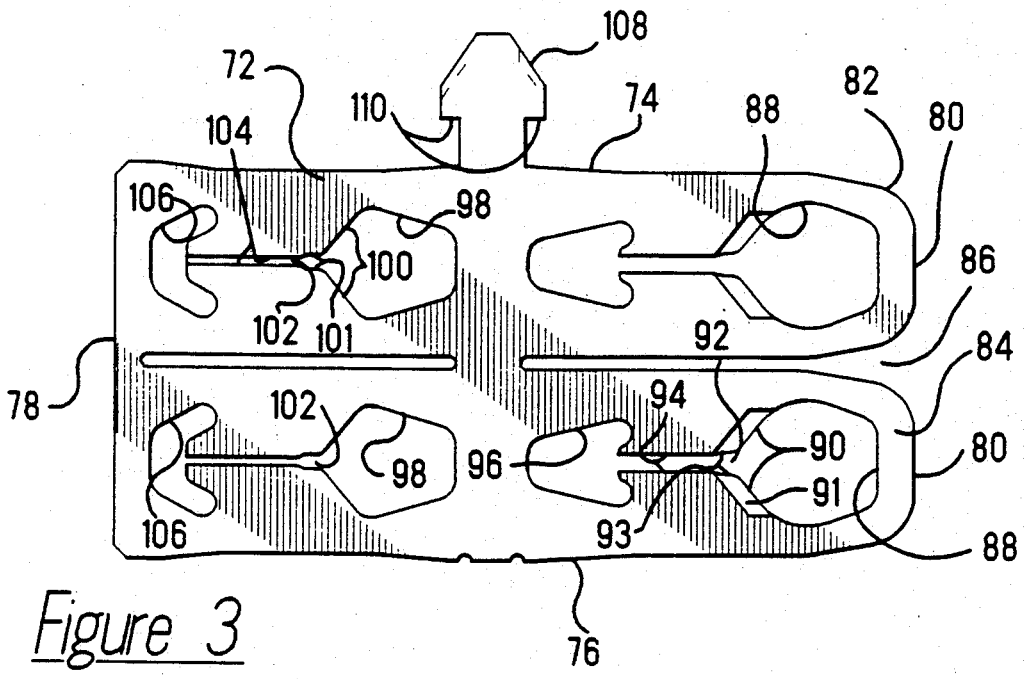
FIG. 3 is a plan view of the stamped blank of the terminal of the present invention.
Figure 5:
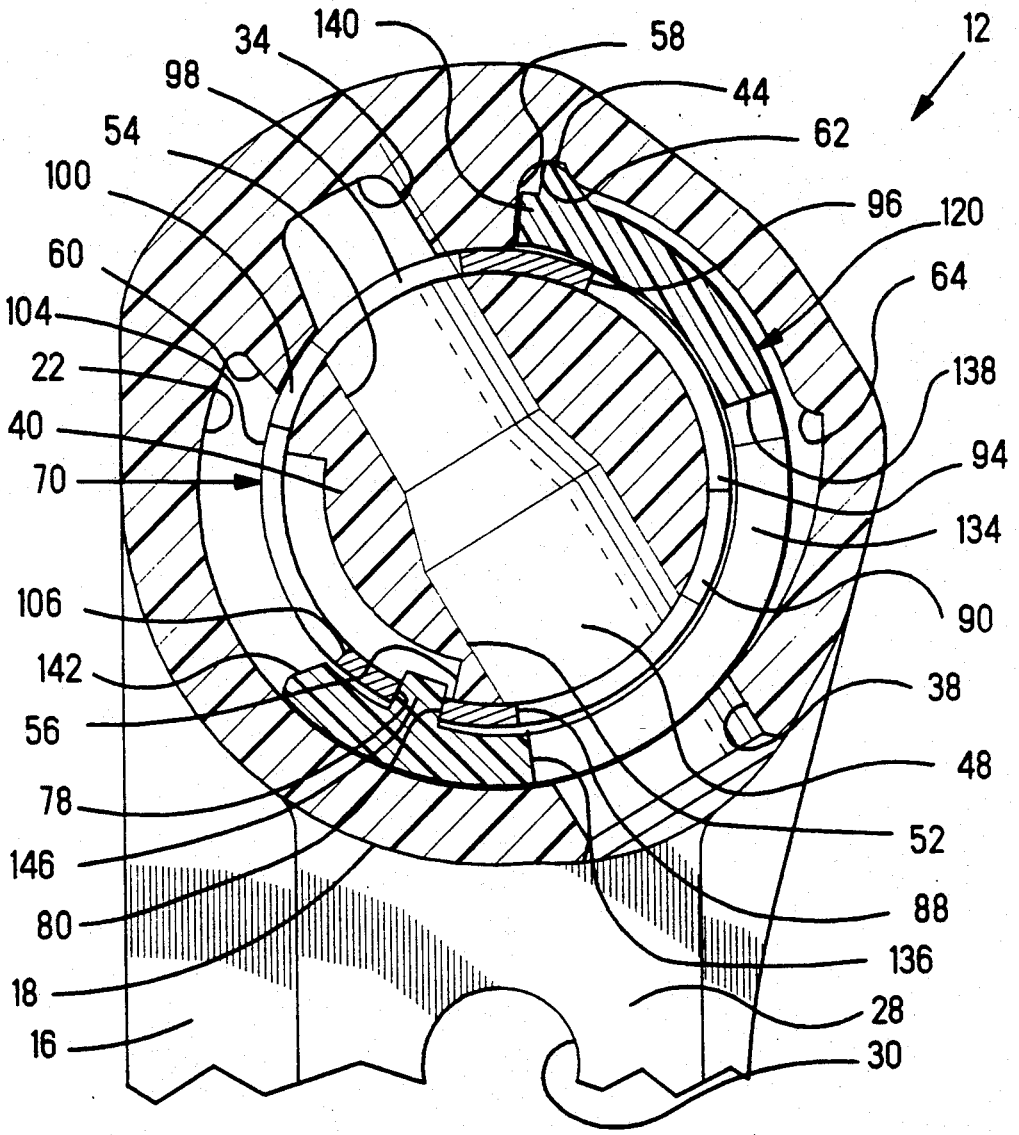

Annular cavity 20 is dimensioned to be wide enough radially, between sidewall 22 and center post surface 42, to receive tubular terminal 70 and tubular actuator 120 inserted thereinto from annular edge 24 and concentrically about center post 40, as seen in FIGS. 2 and 5. FIG. 3 illustrates the terminal of the present invention as blank 72 stamped from a sheet of conductive material such as copper, for example, Copper Alloy 725 and having upper and lower edges 74,76 and first and second lateral edges 78,80. Upper and lower contact sections 82,84 are separated by gaps 86,86A. A pair of large wire-receiving holes 88 are stamped into each of contact sections 82,84 and each includes tapered insulation displacement side edges 90 leading to narrow slot 92 defined between conductor-engaging edges 94; slot 92 continues to relief 96. A pair of small wire-receiving holes 98 are stamped into blank 72 at locations which will be aligned with and opposed from large wire-receiving holes 88 when blank 72 has been formed into its appropriate tubular shape as in FIG. 2, with first and second edges 78,80 opposing each other. Each small wire-receiving hole 98 similarly includes tapered insulation displacement side edges 100 leading to narrow slot 102 defined between conductor-engaging edges 104 leading to relief 106. A probe-engageable tab 108 extends upwardly from upper edge 74 and includes flange sections defining downwardly facing latch surfaces for being affixed to actuator 120.

Actuator 120 is molded of dielectric material such as high temperature resistant, high humidity resistant engineering plastic such as polyphenylene sulfide. Actuator 120 includes a tubular semicylindrical body section 122 extending from bottom edge 124 upwardly to flange 126 having lug 128 formed on and extending upwardly from its upper surface 130. Lug 128 includes a probe-receiving opening 132 thereinto, and probe-engageable tab 108 of terminal 70 is disposed therein upon assembly of the terminal block by means of latch surfaces 110 latching atop corresponding ledges along the inside of probe-receiving opening 132. A pair of large profiled slots 134 is formed on one side of tubular body section 122 associated with wire-receiving apertures 36,38 of housing section 16. Each large slot extends laterally from a wide first end 136 to a narrow and rounded second end 138. Semicylindrical body section 122 is defined angularly between first side edge 140 and second side edge 142 (FIG. 5).

Figure 4:
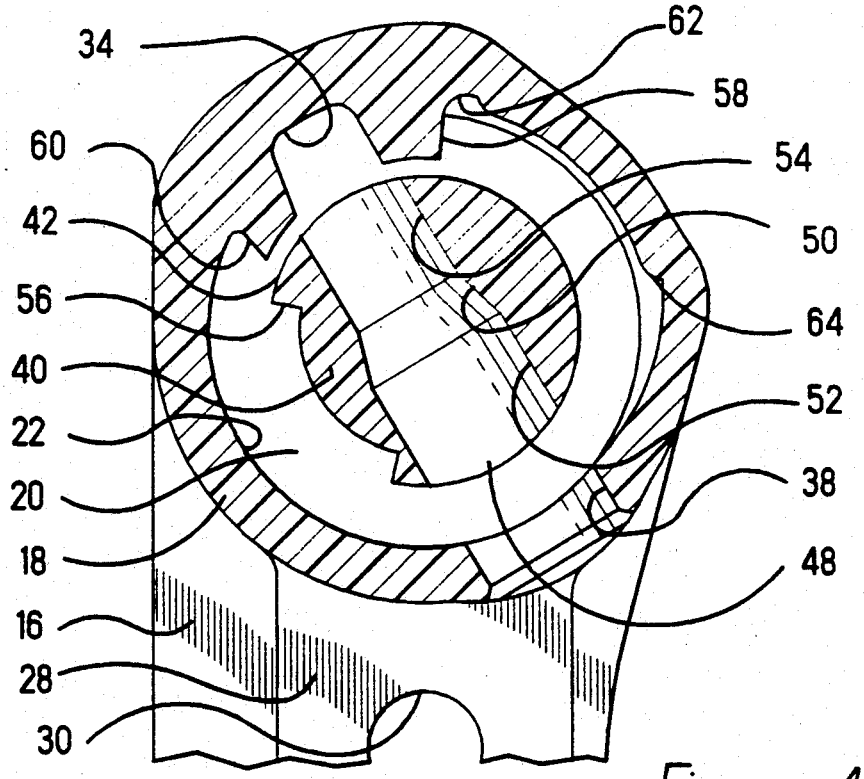
FIGS. 4 and 5 are cross-section views of the terminal block prior to and after assembly of a terminal and actuator thereinto.

Referring to FIGS. 4 and 5, a terminal block 12 is illustrated in cross section at the level of upper opening 38. In FIG. 4, details of annular cavity 20 and center post 40 are clearly shown and provide after assembly and during wire crossconnecting or splicing, for rotation of the terminal by the actuator between first and second positions. Wire aperture 48 extends through center post 40 aligned with wire-receiving aperture 38 through side wall 22 of housing section 18, and includes a larger diameter portion 52, tapered intermediate or transition portion 50, and smaller diameter portion 54 opposed from relief 34 in side wall 22. In FIG. 5, the terminal 70 and actuator 120 have been assembled into cavity 20, with terminal 70 disposed concentrically between center post 40 and actuator 120, and terminal 70 and actuator 120 are in their unactuated or first position ready for wire insertion. Wide first end 136 of large slot 134 of actuator 120 is aligned with and between wire-receiving aperture 38 and large diameter portion 52, and large wire-receiving hole 88 of terminal 70 is also aligned with wire-receiving aperture 38 and large diameter portion 52.

Relevant to the rotation of terminal 70 by actuator 120, a first angular stop surface 58 is associated with first edge 140 of actuator 120, and a second angular stop surface 60 is associated with second edge 142 thereof. A first detent recess 62 cooperates with detent 144 of actuator 120 and defines the unactuated position of the actuator prior to wire connection, and a second detent recess 64 similarly defines the actuated position wherein the terminal will be rotated to connect with and splice together the wires. Angular recess 56 along side surface 42 of center post 40 provides clearance for movement of actuating projection 146 of actuator 120 during rotation.

Figure 6:
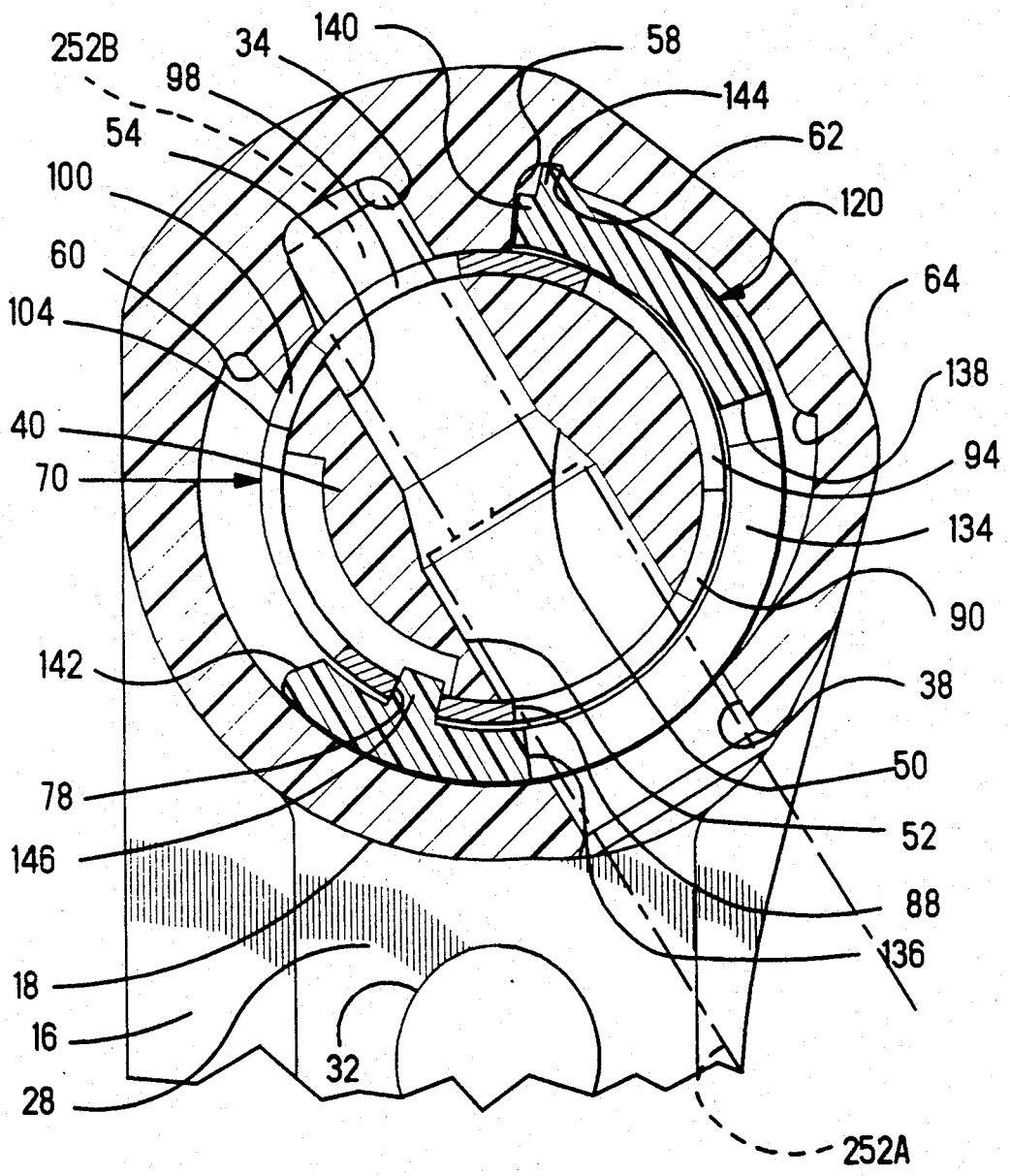
FIGS. 6 and 7 are similar to FIG. 5 after wire insertion in both unactuated and actuated states, with smaller and larger size wires shown in phantom.
Figure 7:
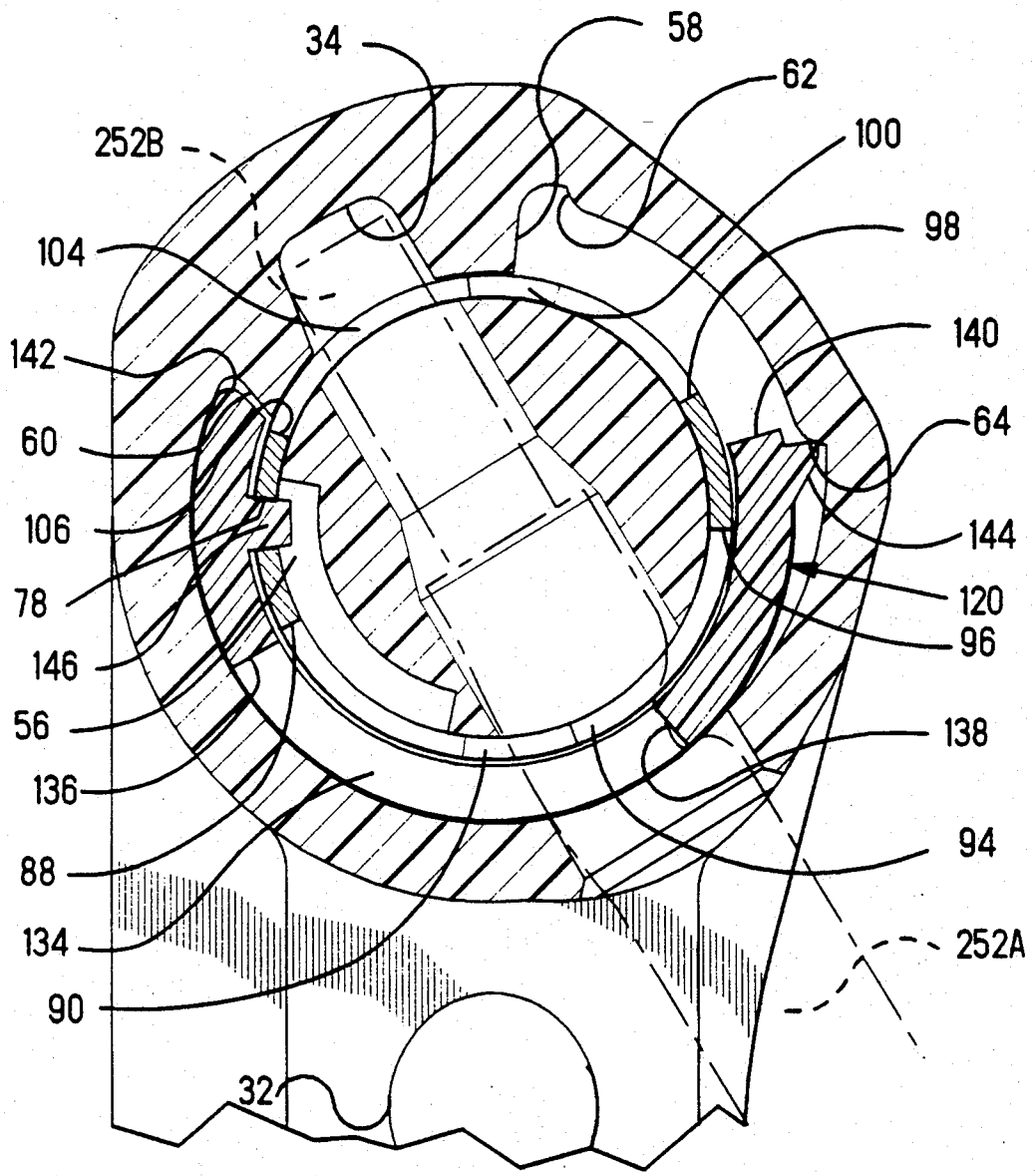

Referring now to FIGS. 6 and 7, the wires to be crossconnected or spliced by terminal block 12 are being inserted and terminated, with only one of the wires shown in phantom as having either a larger gage (252A) or a smaller gage (252B) with both possibilities being illustrated to demonstrate the wire selection feature of the terminal block, as is disclosed in U.S. Pat. No. 5,006,077. The wire extends through aperture 38 of side wall 22, slot 134 of actuator 120, hole 88 of terminal 70 and into large diameter portion 52 of wire aperture 48 of center post 40. A larger gage wire 252A will abut tapered transition portion 50 and be stopped thereby from further insertion; a smaller gage wire 252B will continue to be inserted through smaller diameter portion 54, hole 98 of terminal 70 and into recess 34 along side wall 22 of housing section 18 and stopped.

Actuating projection 146 of actuator 120 extends radially inwardly and is disposed between facing side edges 78,80 of terminal 70 and partially within recess 56 of center post 40. Upon full wire insertion and rotation of actuator 120 by its lug 128, actuator 120 in turn urges terminal 70 to rotate within cavity 20 by projection 146 engaging edge 78, until second edge 142 abuts second stop 60 of housing section 18, and detent 144 is moved from first detent recess 62 to second detent recess 64.

During rotation of terminal 70 by actuator 120, tapered side edges 90 of each large wire-receiving hole 88 engage and begin penetrating or cutting the insulative material of respective wires 252A (or 252B), until side edges 94 of insulation displacement slot 92 engage the central conductor of larger gage wire 252A. Simultaneously, for a smaller gage wire 252B, tapered side edges 100 of each small wire-receiving hole 98 engage and begin penetrating or cutting the insulative material of respective smaller gage wires 252B extending therethrough, if smaller gage wires are being spliced, until side edges 104 of insulation displacement slot 102 engage the central conductor of the smaller gage wire. Terminal 70 thus electrically connects both wires 252A or 252B upon full rotation of actuator 120 between the unactuated and actuated positions.

Gaps 86,86A permit deflection of one side of the insulation displacement slots 92,102 to assure the integrity of the central conductors of wires 252,262 against damage. Slightly larger insulation displacement slot entrances 93,103 center the central conductors of wires 252,262 prior to firm engagement by side edges 94,104 of insulation displacement slots 92,102. Relief portions 96,106 provide against overstressing the terminal upon engagement with the central conductors of the wires. Upon full rotation of actuator 120 during splicing, narrow ends 138 of large profiled slots 134 engage and are forced compressibly into the insulation of wires 252,262 of either large or small gage wire, to define a strain relief on the wires which serves to protect the integrity of the termination of the central conductors to the terminal and held thereagainst by detent 144 in detent recess 64. Commonly the terminal block will be filled with a dielectric grease or gel to embed all metal surfaces and seal the surfaces against moisture and corrosion.

The present invention is modular and permits one enclosure to have provision for securing therein two or more such terminal block modules as desired depending upon the number of telephone wires to be crossconnected at a particular site. Each terminal block is associated with each pair of wires to be crossconnected and includes only one terminal piece per splice which eliminates any possibility of a break in the electrical connection between the two pieces of the prior art rotary terminal assemblies. The terminal block retains the prior art advantage of being usable with both gages of wire commonly used for telephone lines by retaining the wire selection feature. The housing sections on each module are joined by a common base section which easily provides for mounting within the enclosure, with the wire-receiving holes oriented at a common angle with respect to the base section so that neither housing section interferes with wire insertion, and the holes are aligned with the enclosure's cable exit upon mounting in the enclosure.

Modifications and variations may be made to the terminal and the modular terminal block which are within the spirit of the invention and the scope of the claims.

What is claimed is:

1. A modular terminal block for cross-connecting to each other ones of respective conductors of a pair of two-conductor cables whose ends are brought into an enclosure through a common cable entrance at a single location, comprising:

a housing member defining two housing sections coextending from a common transverse base section, said base section including means for being mounted to and within said enclosure;

each said housing section including a cylindrical wall having an inner surface defining a cavity and further including a center post within said cavity extending from said base section and having an outer surface spaced inwardly a selected distance from said inner wall surface, whereby said cavity is annular about said center post;

a pair of wire-receiving holes through said cylindrical wall in communication with said annular cavity, and a pair of wire-receiving apertures at least into said center post aligned with said wire-receiving holes, enabling insertion of ends of said associated ones of said wires of said cables respectively thereinto to be spliced, said wire-receiving holes of both said housing sections being oriented in a common direction angularly offset with respect to the row defined by said housing sections, enabling orientation of said housing member during mounting for said wire-receiving apertures to be aligned generally toward a single cable-receiving aperture of said enclosure;

a tubular terminal member disposed in each said annular cavity and adjacent said center post, each said terminal member including at least a first wall section disposed between said center post and said cylindrical housing wall proximate said wire-receiving holes thereof, said first terminal wall section including a pair of first wire-receiving holes therethrough aligned with respective wire-receiving holes of said cylindrical housing wall and respective said wire-receiving apertures of said center post, said terminal member further including first insulation displacement slots extending circumferentially thereabout from respective said first wire-receiving holes;

a tubular actuator disposed in each said annular cavity about a corresponding said terminal member and adjacent said inner cylindrical wall surface of a corresponding said housing section, each said actuator including means engaging said terminal member to rotate said terminal member when said actuator is rotated following insertion of said pair of wire ends to be spliced; and each said housing section including detent means cooperable with detent means of a corresponding said actuator to define unactuated and actuated positions of said actuator, whereby an enclosure-mountable modular assembly is defined completely providing for conveniently cross-connecting the associated conductors of a pair of two-conductor cables and housing and cross-connections.

2. A modular terminal block as set forth in claim 1 wherein said housing sections are spaced apart along said base section defining an accessible intermediate base portion therebetween, and said intermediate base portion includes a fastener-receiving aperture therethrough for said housing member to be mounted to a wall of said enclosure at a selected location.

3. A modular terminal block as set forth in claim 1 wherein said wire-receiving apertures of both said housing sections are angularly offset with respect to the row defined by said housing sections, whereby one of said housing sections does not interfere with wire insertion.

4. A modular terminal block as set forth in claim 3 wherein said wire-receiving apertures of both said housing sections are oriented in a common direction.

5. A modular terminal block for cross-connecting to each other associated ones of respective conductors of wires of a pair of two-wire cables, comprising:

a housing member defining two housing sections coextending from a common transverse base section and spaced apart therealong to define an intermediate base portion accessible therebetween, said intermediate base portion including a fastener-receiving aperture therethrough, whereby said housing member is adapted to be mountable to a panel means;

each said housing section including a cylindrical wall having an inner surface defining a cavity and further including a center post within said cavity extending from said base section and having an outer surface spaced inwardly a selected distance from said inner wall surface, whereby said cavity is annular about said center post;

a pair of wire-receiving holes through said cylindrical wall in communication with each said annular cavity, and a pair of wire-receiving apertures at least into said center post aligned with said wire-receiving holes, enabling insertion of ends of said associated ones of said wires of said cables respectively thereinto to be spliced;

a tubular terminal member disposed in each said annular cavity and adjacent said center post, said terminal member including at least a first terminal wall section disposed between said center post and said cylindrical housing wall proximate said wire-receiving holes thereof, said first terminal wall section including a pair of first wire-receiving holes therethrough aligned with respective said wire-receiving holes of said cylindrical housing wall and respective said wire-receiving apertures of said center post, said terminal member further including first insulation displacement slots extending circumferentially thereabout from respective said first wire-receiving holes;

a tubular actuator disposed in each said annular cavity about a corresponding said terminal member and adjacent said inner cylindrical wall surface of a corresponding said housing section, said actuator including means engaging said terminal member to rotate said terminal member when said actuator is rotated following insertion of a corresponding said pair of wire ends to be spliced; and each said housing section including detent means cooperable with detent means of a corresponding said actuator to define unactuated and actuated positions of said actuator, whereby a panel-mountable modular assembly is defined for convenient cross-connecting of associated conductors of a pair of two-conductor cables and housing the cross-connections.

6. A modular terminal block as set forth in claim 5 wherein said wire-receiving apertures of both said housing sections are angularly offset with respect to the row defined by said housing sections and oriented in a common direction, whereby one of said housing sections does not interfere with wire insertion into the other of said housing sections.

7. A modular terminal block as set forth in claim 5 wherein each said tubular actuator includes a pair of slots aligned with said wire-receiving holes of said housing means through which respective said wire ends are insertable when said actuator is in said unactuated position, and said slots having ends clamping insulation of said wire ends in cooperation with opposing sides of said wire-receiving holes and said wire-receiving apertures of said cylindrical housing wall and said center post respectively to define a wire strain relief upon actuation.

8. A modular terminal block as set forth in claim 5 wherein each said wire-receiving aperture of said center post extends completely therethrough, and each said terminal member includes a second terminal wall section disposed between said center post and said cylindrical housing wall opposed from said wire-receiving holes of said cylindrical housing wall, said second terminal wall section including second wire-receiving holes diametrically opposed from said first wire-receiving holes through which extend ends of said associated ones of said wires after passing through said wire-receiving apertures of said center posts, said second wire-receiving holes including second insulation displacement slots extending circumferentially therefrom an extending through insulation of respective ones of said associated wires and electrically engageable with said conductors thereof upon rotation of said terminal member following insertion of said wire ends through said second wire-receiving holes thereof.

9. A cross-connected cable assembly of a pair of two-wire cables within a common housing means, comprising:

a housing member defining two housing sections coextending from a common transverse base section, each having a terminal member secured therewithin splicing ends of associated ones of wires of said two-wire cables;

each said housing section including a cylindrical wall having an inner surface defining a cavity and further including a center post within said cavity extending from said base section and having an outer surface spaced inwardly a selected distance from said inner wall surface, whereby said cavity is annular about said center post;

a pair of wire-receiving holes through said cylindrical wall of communication with said annular cavity, and a pair of wire-receiving apertures at least into said center post aligned with said wire-receiving holes, into and through which extend ends of said associated ones of said wires of said cables respectively, said wire-receiving holes of both said housing sections being oriented in a common direction angularly offset with respect to the row defined by said housing sections, enabling orientation of said housing member during mounting for said wire-receiving apertures to be aligned generally toward a single cable-receiving aperture of said enclosure and receive said ones of said wires from a common location;

each said terminal member being tubular and disposed in a respective said annular cavity and adjacent said center post, said terminal member including at least a first terminal wall section disposed between said center post and said cylindrical housing wall proximate said wire-receiving holes, said first terminal wall section having a pair of first wire-receiving holes therethrough aligned with respective said wire-receiving holes of said cylindrical housing wall and respective said wire-receiving apertures of said center post, said first wire-receiving holes of said terminal member including first insulation displacement slots extending circumferentially thereabout from respective said first wire-receiving holes extending through insulation of respective ones of said associated wires and electrically engaged with said conductors thereof after rotation of said terminal member following insertion of said ends through said first wire-receiving holes thereof;

a tubular actuator disposed in each said annular cavity about a corresponding said terminal member and adjacent said inner cylindrical wall surface of said housing section, said actuator including means engaging said terminal member to rotate said terminal member between actuated and unactuated positions; and each said housing section including detent means cooperable with detent means of a corresponding said actuator to define unactuated and actuated positions of said actuator, whereby first wires of both said two-wire cables are spliced together and second wires of both said two-wire cables are spliced together by respective terminals in a common housing member.

10. A cross-connected cable assembly as set forth in claim 9 wherein each said tubular actuator includes a pair of slots having ends clamping insulation of said wire ends in said actuated position in cooperation with opposing sides of said wire-receiving holes and said wire-receiving apertures of said cylindrical housing wall and said center post respectively to define a wire strain relief.

11. A cross-connected cable assembly as set forth in claim 9 wherein each said wire-receiving aperture of said center post extends completely therethrough, and each said terminal member includes a second terminal wall section disposed between said center post and said cylindrical housing wall opposed from said wire-receiving holes of said cylindrical housing wall, said second terminal wall section including second wire-receiving holes diametrically opposed from said first wire-receiving holes through which extend ends of said associated ones of said wires after passing through said wire-receiving apertures of said center posts, said second wire-receiving holes including second insulation displacement slots extending circumferentially therefrom and extending through insulation of respective ones of said associated wires and electrically engaged with said conductors thereof after rotation of said terminal member following insertion of said wire ends through said second wire-receiving holes thereof.

* * * * *